US005188360A

United States Patent [19]

Chen

[11] Patent Number: 5,188,360

[45] Date of Patent: Feb. 23, 1993

[54] STRUCTURE OF RACKET WITH IMPROVED WEIGHT DISTRIBUTION ADJUSTING MECHANISM

[76] Inventor: Dennis Chen, 293 Pei Tun Road, Taichung, Taiwan

[21] Appl. No.: 574,593

[22] Filed: Aug. 29, 1990

[51] Int. Cl.[5] ..... A63B 49/00

[52] U.S. Cl. ..... 273/73 R

[58] Field of Search ..... 273/73 R, 67 R, 67 DB

[56] References Cited

U.S. PATENT DOCUMENTS 4,353,551 10/1982 Arieh et al. ..... 273/73 R

*Primary Examiner*—William H. Grieb

[57] ABSTRACT

A racket, which is comprised of a head frame laterally and longitudinally inserted therethrough with a catgut string to form a striking surface, and a racket handle for grasping in the hand. The head frame has at least one vertical hole made thereon and vertically passing through the upper and lower edges thereof to divide the head frame into an inner and an outer frame portion with the catgut string transversely inserted therethrough. At least one elastic counter weight which has a plurality of through-holes thereon and spaced away from one another at an interval corresponding to the mesh of the striking surface for the insertion therethrough of the catgut string is provided to be releasably fixed in the vertical hole to change the weight distribution of the racket.

1 Claim, 2 Drawing Sheets

STRUCTURE OF RACKET WITH IMPROVED WEIGHT DISTRIBUTION ADJUSTING MECHANISM

BACKGROUND OF THE INVENTION

The present invention is related to rackets and more particularly to a racket with an improved structure for adjusting its weight distribution.

In the game of tennis, a player must have a racket that is properly adjusted in weight distribution in order for him to play to his potential. According to conventional methods, the weight distribution of a racket is generally adjusted by means of attaching different counter-weights to a clamping device which is rigidly mounted on the head frame of a racket, or by changing the position of a counter-weight clamping device on the striking surface of a racket. One disadvantage of these these conventional methods is that the weight distribution adjusting procedure requires the use of a separate tool. Another disadvantage of these conventional methods is that the mounting of a counter-weight clamping device on the head frame or the striking surface of a racket is detrimental to the esthetics and structure of the racket.

SUMMARY OF THE INVENTION

The present invention has been accomplished under the circumstances in view. It is an object of the present invention to provide a racket which can be conveniently adjusted in its weight distribution.

It is another object of the present invention to provide a racket which can greatly reduce shock in the head frame when a ball is struck.

To accomplish the above objects and in accordance with the aspects of the present invention, there is provided a racket being comprised of a head frame, which is latitudinally and longitudinally threaded therethrough with a catgut string to form a striking surface therein for striking a ball, and a racket handle for gripping in the hands. The head frame has at least one vertical hole made thereon and vetically piercing through the upper and lower edges thereof to divide the head frame into an inner and an outer frame portion with the catgut string transversely threaded therethrough. At least one elastic counter-weight which has a plurality of through holes on its one side, and spaced away from one another at an integral corresponding to the mesh of the striking surface, for the insertion therethrough of the catgut string is provided to releasably set in the vertical hole to change the weight distribution of the racket.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
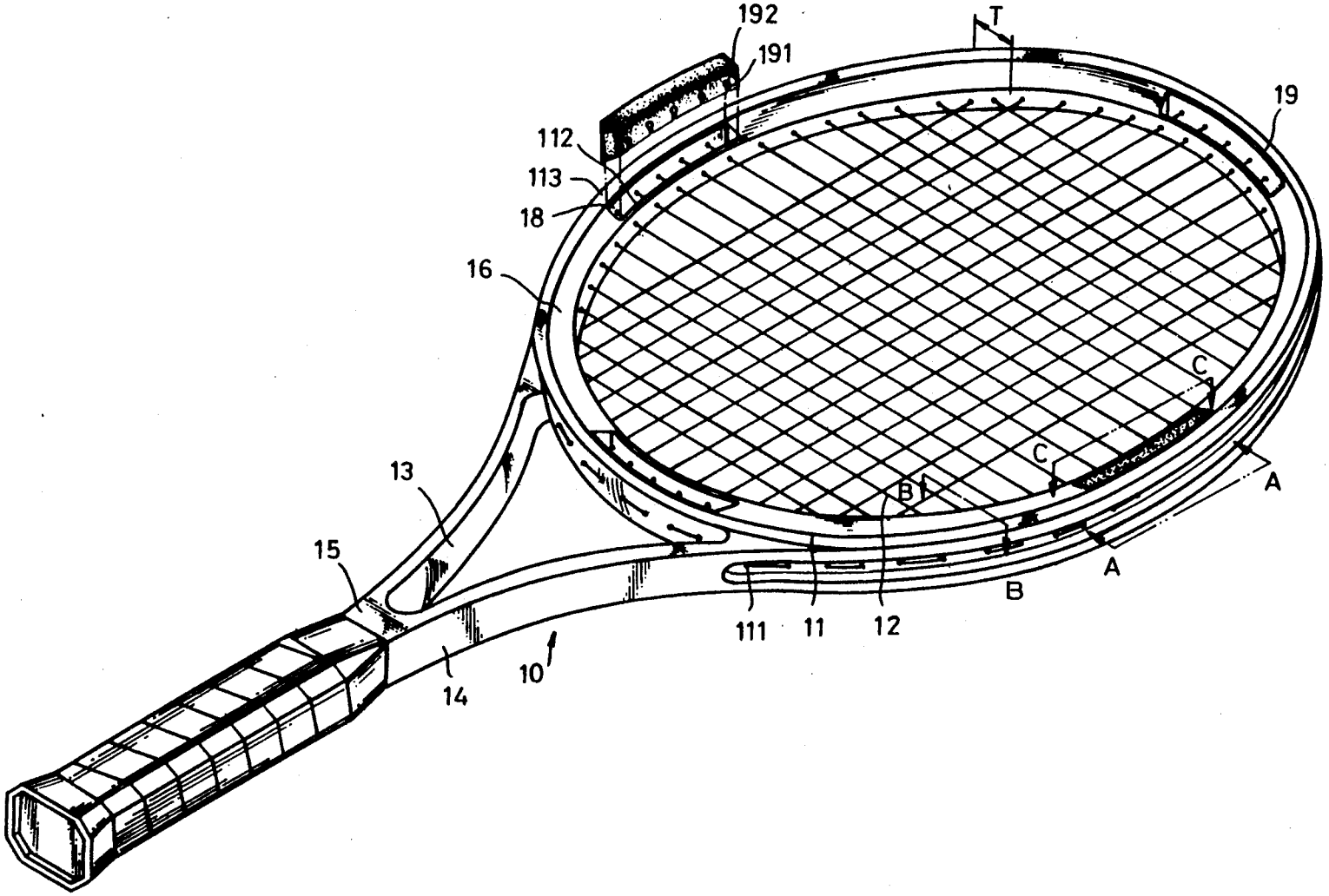
FIG. 1 is a perspective view of a tennis racket embodying the present invention.
Figure 3:
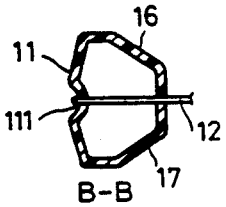
FIG. 3 is a section view taken on line B—B of FIG. 1.
Figure 2:
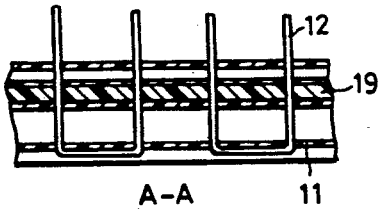
FIG. 2 is a sectional view taken on line A—A of FIG. 1.
Figure 4:
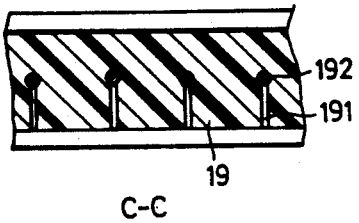
FIG. 4 is a sectional view taken on line C—C of FIG. 1.

Turning now to the annexed drawings in greater detail and referring first to FIG. 1, therein illustrated is a tennis racket 10 embodying the present invention, which comprises a head frame 11 of a substantially oval shape having a plurality of thread holes 111 disposed horizontally around its periphery for the threading therethrough longitudinally and latitudinally of a catgut string 12 to form a striking surface according to a predetermined tension. Two unitary support bars 13 and 14 curvilinearly extend from the rear end of the head frame 11 to concomitantly merge in a racket handle 15. As illustrated in FIG. 3, the upper edge 16 and the lower edge 17 of the head frame 11 are significantly inclining inward to form a circular inner wall surface so as to minimize wind resistance. The maximum width T of the head frame 11 is preferably designed within 12–18 cm.

The head frame 11 has thereon a plurality of vertical holes 18 passing through its upper and lower edges 16 and 17 inter-spaced at a proper interval. The vertical holes 18 are each formed in a curved shape, conforming with the curvature of the head frame 11 and in a length approximately equal to 2–6 meshes of the striking surface. Thus, the head frame 11 is substantially divided by the vertical holes 18 into an inner frame portion 112 and an outer frame portion 113. The width T of the head frame 11 must be slightly larger than what is commonly used so that greater structural strength of the head frame 11 can be secured. In the present embodiment, the outer frame portion 113 is designed with a width of 6 mm., the inner frame portion 112 is designed with a width of 3 mm, and the verticals 18 are each designed with a width of 3 mm. In regular tennis rackets or squash rackets, either of large or medium size, the striking surface of a racket varies in tension as well as in size. Therefore, there is no strict limitation on the width of the head frame 11. For example, if the material for the head frame 11 contains a high percentage of carbon fibers, the width of the head frame 11 may be relatively reduced. In short, the width T of the head frame of racket can be flexibly increased or reduced according to actual requirements during the manufacturing process.

As shown in FIG. 1, one or more counter-weights 19 may be selectively set in either of the vertical holes 18 to change the weight distribution of the racket. According to the present invention, a counter-weight 19 is made of an elastic material having a plurality of narrow openings 191 on its bottom and spaced at an interval equal to the size of the mesh of the striking surface, with narrow openings 191 each terminating in a semi-circular hole 192 on its top, with a diameter approximately equal to the outer diameter of the catgut string 12 of the striking surface. Therefore, an elastic counter weight 19 can be conveniently inserted into either of the vertical holes 18 of the head frame 11 permitting several strings of the striking surface to pass through the narrow openings 191 into the expanded holes 192 to firmly retain such a counter weight 19 in the vertical hole 18 in which it is inserted. Thus, by means of changing a counter-weight 19 from one of the vertical holes 18 to another, the weight distribution of the racket is also changed.

When a counter weight 19 is inserted in either of the vertical holes 18 of the head frame 11, the weight distribution of the racket is simultaneously changed. Because a counter weight 19 is to be set between the inner and outer frame portions 112 and 113, it can also absorb any possible shock from the head frame 11 of the racket when it is set in either of the vertical holes 18 to change the weight distribution of the racket.

Figure 5:
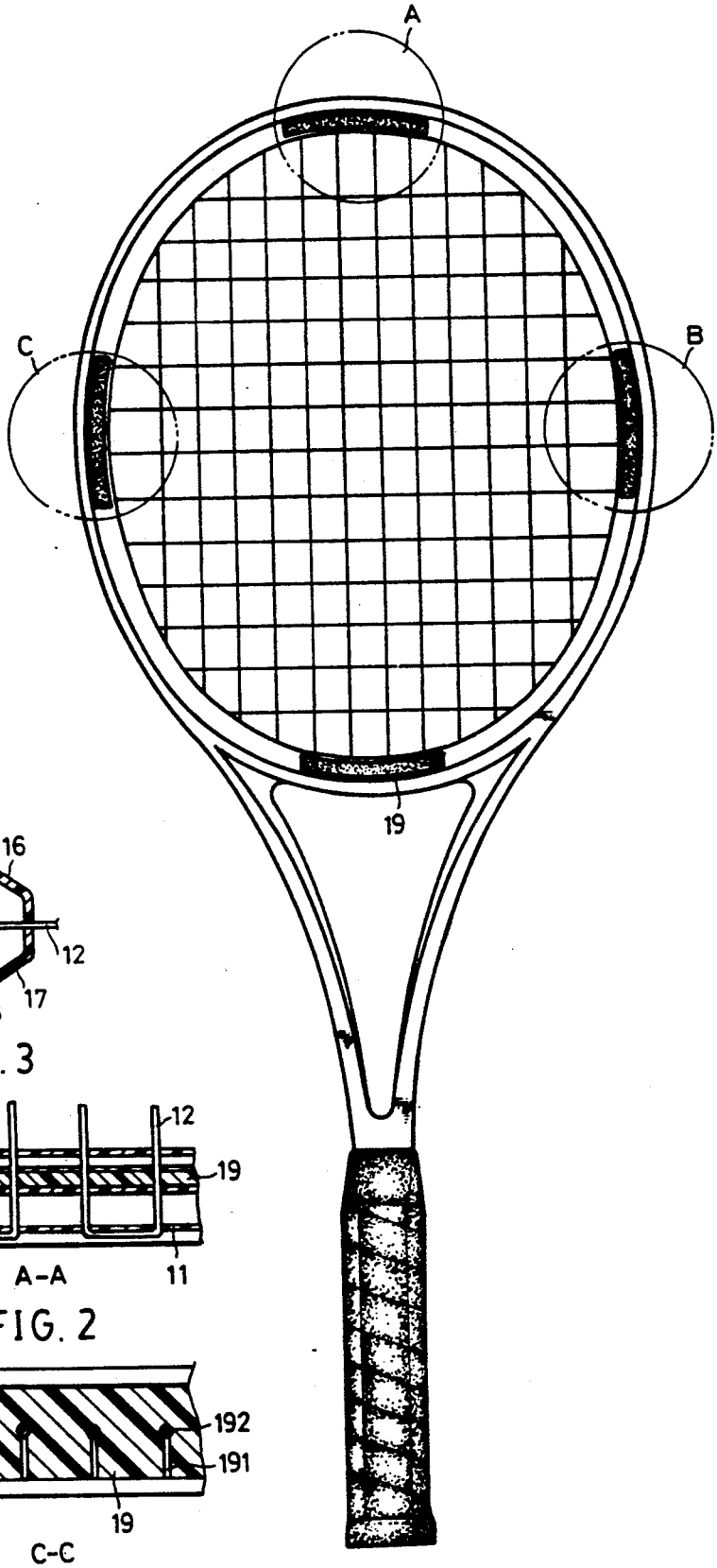
FIG. 5 is a schematic drawing illustrating the arrangement of counter-weights on the head frame of the present invention.

When no counter weight is used, the racket serves as a conventional racket. When it is required to change the weight distribution of the racket, one or more counter weights 19 can be flexibly set in the vertical holes 18 according to the conditions. Generally, when a counter weight 19 is mounted on the head frame at a position A as indicated in FIG. 5 the center of gravity is shifted towards the front of the racquet. Under this arrangement, the racket is more practical for exercising the strength of the wrist. In case a counter weight 19 is set at a position B, it minimizes possible torque on the racket when a ball hits the striking surface off to one side of the racquet centerline.

To remove a counter weight 19 from the head frame 11 of the racket, a thin rod can be used to press on a counter weight 19 against the side where the narrow holes 191 are made so that a counter weight 19 can be conveniently pushed out of the head frame 11.

I claim:

1. A racket comprising:

a head frame having a catgut string laterally and longitudinally inserted therethrough to form a striking surface;

at least one vertical hole passing through the upper and lower edges of said frame to divide said frame into an inner frame portion and an outer frame portion permitting said catgut to transversely insert therethrough;

a racket handle extending from said head frame for grasping in the hand;

at least one elastic counter weight for releasably fastening in said vertical hole having a plurality of through-holes thereon and spaced apart from one another at an interval corresponding to the mesh of said striking surface for the insertion vertically therethrough of said catgut string;

said counter weight having a plurality of narrow openings on one side and extending from said through-holes, each of said narrow openings formed in a size slightly smaller than the diameter of said catgut string;

wherein said counter weight is permitted to snap fit into and release from said vertical holes.

* * * * *